F6966 XR 4,390,441

United States Patent [19]

Beavan

[11] 4,390,441

[45] Jun. 28, 1983

[54] MACHINE DISHWASHING COMPOSITION

[75] Inventor: Stuart W. Beavan, Birkenhead, England

[73] Assignee: Lever Brothers Company, New York, N.Y.

[21] Appl. No.: 251,035

[22] Filed: Apr. 6, 1981

[30] Foreign Application Priority Data

Apr. 11, 1980 [GB] United Kingdom ..... 8012050

[51] Int. Cl.[3] ..... C11D 9/42

[52] U.S. Cl. ..... 252/96; 8/103; 8/108 R; 8/108 A; 252/99; 252/100; 252/103; 252/105; 252/135

[58] Field of Search ..... 252/95, 99, 105, 135, 252/96, 100, 103; 8/108 R, 108 A, 103

[56] References Cited

U.S. PATENT DOCUMENTS

| | | | |
|---|---|---|---|
| 2,161,045 | 6/1939 | Hirschkind et al. | 8/106 |
| 2,253,368 | 8/1941 | Dubeau | 8/108 |
| 2,482,891 | 9/1949 | Aston | 252/187 |
| 3,063,783 | 11/1962 | Wagner | 8/108 |
| 3,111,358 | 11/1963 | Doerr | 8/108 |
| 3,434,974 | 3/1969 | Austin et al. | 252/138 |
| 3,547,573 | 12/1970 | Tourdot et al. | 252/94 X |
| 3,562,165 | 2/1971 | Altieri | 252/99 |
| 3,640,878 | 2/1972 | Chirash et al. | 252/99 |
| 3,671,440 | 6/1972 | Sahatelli et al. | 252/99 X |
| 3,679,589 | 7/1972 | Schnegelberger et al. | 252/99 X |
| 3,696,041 | 10/1972 | Gray | 252/99 |
| 3,728,266 | 4/1973 | Komeda et al. | 252/99 X |
| 3,798,181 | 3/1974 | Vazquez | 252/539 |
| 3,836,475 | 9/1974 | Kirner | 252/102 X |
| 4,005,027 | 1/1977 | Hartman | 252/99 X |
| 4,033,718 | 5/1977 | Holcombe et al. | 252/99 X |
| 4,033,818 | 7/1977 | Pourrat | 424/195 X |
| 4,051,055 | 9/1977 | Trinh et al. | 252/99 X |
| 4,051,056 | 9/1977 | Hartman | 252/99 |
| 4,104,190 | 8/1978 | Hartshorn | 252/95 X |
| 4,151,104 | 4/1979 | Aluarez et al. | 252/99 |
| 4,287,079 | 9/1981 | Robinson | 252/99 |
| 4,332,691 | 6/1982 | Beaven | 252/100 X |

FOREIGN PATENT DOCUMENTS

| | | |
|---|---|---|
| 676238 | 2/1966 | Belgium . |
| 1253397 | 11/1967 | Fed. Rep. of Germany . |
| 288654 | 4/1928 | United Kingdom . |
| 821168 | 9/1959 | United Kingdom . |
| 964728 | 7/1964 | United Kingdom . |
| 981645 | 1/1965 | United Kingdom . |
| 992952 | 5/1965 | United Kingdom . |
| 992953 | 5/1965 | United Kingdom . |
| 992954 | 5/1965 | United Kingdom . |
| 992955 | 5/1965 | United Kingdom . |
| 1071494 | 6/1967 | United Kingdom . |
| 1073165 | 6/1967 | United Kingdom . |
| 1121756 | 7/1968 | United Kingdom . |
| 1137474 | 12/1968 | United Kingdom . |
| 1266896 | 3/1971 | United Kingdom . |
| 1236710 | 6/1971 | United Kingdom . |
| 1397595 | 6/1975 | United Kingdom . |
| 1402326 | 8/1975 | United Kingdom . |
| 1453383 | 10/1976 | United Kingdom . |
| 1539017 | 1/1979 | United Kingdom . |
| 2020331 | 11/1979 | United Kingdom . |

OTHER PUBLICATIONS

Textil-Praxis International, vol. 29, Sep. 1974, pp. 1251–1253, 1728–1730.

*Primary Examiner*—Michael R. Lusignan
*Attorney, Agent, or Firm*—James J. Farrell

[57] ABSTRACT

A composition in solid or liquid form for machine dishwashing is disclosed, containing a builder such as a phosphate salt, an alkaline material such as sodium silicate and a halite such as sodium chlorite. The composition is for use with a machine incoporating an ultraviolet light source to irradiate the dishes and/or the liquor. The composition may also include a low-foaming or non-foaming surfactant and other usual adjuncts, especially enzymes. An exemplified composition is 33% tripolyphosphate, 27% sodium disilicate, 33% chlorite, 7% sodium tetraborate.

6 Claims, No Drawings

MACHINE DISHWASHING COMPOSITION

This invention relates to a dishwashing composition, particularly to a machine diswashing composition having a stain removal and germicidal effect.

Machine dishwashing compositions comprising one or more builder materials, alkaline materials and optionally a surfactant are known.

For the purposes of stain removal, particularly the removal of tea and coffee stains, and for the purposes of providing a germidical effect, it is known to include hypochlorite compounds in machine dishwashing formulations. However, the use of hypochlorite leads to two serious disadvantages. Firstly, the hypochlorite material is generally unstable and this results in storage difficulties. Secondly, it may be desired to incorporate in machine dishwashing compositions materials which are incompatible with the hypochlorite, such as enzymes, certain perfumes and other organic materials.

It is an object of this invention to provide an improved machine dishwashing composition which provides a stain removal and germicidal effect, which has improved storage properties and which is compatible with chlorine sensitive materials.

It is known that alkalimetal chlorites are oxidizing agents, but for practical purposes they are relatively ineffective under alkaline conditions. Chlorites are used as oxidizing agents in acid media, for example for bleaching cellulose, the chlorite in acid media producing chlorine dioxide which is the species responsible for the bleaching. Acidic media are generally unsuitable for machine dishwashing.

It is also known to activate chlorites at high pH with activators such as hydroxylammonium salts (see U.S. Pat. No. 3,836,475) but such activators are expensive and may also be toxic. For these reasons they have not found commercial success.

It is further known from British Patent Specification No. 1,397,595 to use alkali metal chlorite, particularly sodium chlorite ($NaClO_2$), activated by high energy radiation, particularly from X-rays, $\gamma$-rays and electron rays, for bleaching organic materials under alkaline conditions.

We have now discovered that satisfactory soil breakdown, stain removal and germ killing on dishes, cutlery and the like can be obtained using a formulation containing a chlorite, or other halite, if the formulation and/or the dishes in contact therewith are exposed to ultraviolet light having a wavelength of between 200 nm and 400 nm. We have also discovered that formulations containing chlorite before exposure to UV-light have improved storage stability and are compatible with chlorine sensitive materials.

Thus, according to the invention there is provided a machine dishwashing composition in liquid and/or solid form comprising:

(i) from 1% to 99.5%, preferably from 10% to 60%, by weight of one or more builder materials, as hereinafter defined;

(ii) from 0.5% to 60%, preferably from 5% to 45%, by weight of a material yielding halite ions in aqueous media;

(iii) sufficient alkaline material to give the composition a pH of at least 7.0 when dispersed at 0.5 g/l in water; optionally (iv) up to 40%, preferably less than 15% by weight of one or more surfactants; and optionally (v) up to 98.5% by weight of a liquid base such as water.

According to a second aspect of the invention, there is provided a process for washing dishes comprising the steps of:

(a) contacting the dishes with an aqueous liquor comprising at least about 0.5 g/l of the above described composition, and (b) irradiating the aqueous liquor and/or dishes in contact therewith with ultraviolet light having a wavelength of between 200 nm and 400 nm.

The dishwashing compositions according to the invention are adapted for machine dishwashing. The term "dishwashing" is intended to cover the washing of not only dishes but also cutlery, pans, cooking utensils and the like. The preferred form of the composition is a powder, but it may be in any other solid form such as tablets, or in the form of a liquid. When in solid form, the composition will usually contain less than about 30% by weight liquid base.

It is also possible to use a system in which a composition according to the invention is used in association with other compositions optionally being themselves formulated according to the invention. For example, a separate liquid composition could be used together or in sequence with a powder, one of them, or both being formulated according to the invention.

As used herein, the term "builder" is intended to cover any material which will remove calcium ions from solution by, for example, sequestration, complexation, precipitation or ion exchange. Examples of such builders are water-soluble phosphates such as the orthophosphates, pyrophosphates, tripolyphosphates, metaphosphates, polymetaphosphates of alkalimetals such as sodium, or hydrates thereof.

Other useful inorganic builders which can be used preferably in admixture with other alkaline salts and/or other builders include carbonates and aluminosilicates.

Organic builders may also be used in compositions according to the invention. They include for example soaps; polycarboxylic acids and their salts such as sodium citrate; aminopolyacetates, like ethylene diamine tetraacetate (EDTA) or nitrilotriacetate (NTA) and also polyphosphates and generally all polymeric materials having a builder capacity.

Most builder materials are alkaline and may, together with the halite material, render the composition the desired pH without the addition of further alkaline materials. However, further alkaline material will normally be added. This alkaline material may be a water-soluble silicate, for example those having the general formula $XSiO_2.M_2O$, where X is from 0.5 to 4 and M is a cation such as sodium or potassium. Other non-limiting examples of alkaline salts are carbonates, bicarbonates, sesquicarbonates, borates, acetates, hydroxides and mixtures thereof.

A composition according to the invention may contain one or more surfactants, selected from anionic, nonionic, zwitterionic, amphoteric and cationic materials. A low-foaming or non-foaming surfactant, particularly nonionic in character, is preferred. Some typical examples of surfactants are alkyl and alkaryl sulphonates, alcohol sulphates and ethoxy sulphates, soaps, polyalkylene oxide condensates with aliphatic or alkylaromatic compounds, polymer and copolymers of alkylene oxide and their derivatives, alkyl phosphates, amine oxides and aliphatic quaternary compounds.

If present, only minor amounts of surfactants are generally used.

The material yielding halite ions in aqueous media is selected from chlorites and bromites, preferably chlorites, of substituted or unsubstituted ammonium, alkali metals (for example sodium, potassium or lithium) or alkaline earth metals (for example calcium or magnesium). The preferred material is sodium chlorite.

In use, the dishwashing composition is dispersed in water before contacting the dishes. Preferably the composition is dispersed with water to a concentration of about 0.5 g/l to about 10 g/l. It is essential that in this dispersed state the composition has a pH of at least 7.0, preferably from about 8.5 to about 11.5.

The exposure to ultraviolet light may be achieved by exposing the dispersed composition or the dishes in contact therewith to an artificial source of ultraviolet light. Thus the dispersed composition may be irradiated before contact with the dishes or while the dispersed composition is in contact with the dishes. It is essential that this irradiation occurs before the halite is removed, e.g. by rinsing, from the dishes. The ultraviolet light has a component with a wavelength of between about 200 nm and about 400 nm, preferably less than 370 nm.

The intensity of the ultraviolet light, as measured at the surface of the dishes or at the surface of the liquor is preferably from about 0.01 to about 10.0, more preferably from about 0.05 to about 2.0 $Wm^{-2}nm^{-1}$. Under these conditions a suitable exposure time is between about 10 minutes and about 10 hours, more preferably between about 30 minutes and about 4 hours, depending on the concentration of the chlorite in the liquor and on the degree of stain removal or germ killing required. The preferred light intensity can alternatively be expressed as from about $10^{-1}$ to about $10^{-6}$, preferably from about $10^{-2}$ to about $10^{-4}$ Einsteins of energy in the 200 nm to 370 nm wavelength region per liter of liquor.

As the exposure to ultraviolet light causes a breakdown of the chlorite ion in water, it is preferable that the dishwashing composition be stored before use in a UV-opaque container if it is a liquid.

The dishwashing composition may contain one or more ingredients in addition to those specified above, for example: fillers such as sulphates, chlorides, calcites, silicas, clays and sugars; suds modifiers or regulating agents such as soaps, alkyl phosphates, waxes and siloxanes; antiredeposition agents such as modified cellulose or starch derivatives; polymers, perfumes and perfume carriers; enzymes such as proteolytic and amylolitic enzymes; non-aqueous solvents including propellants, hydrotropes such as urea, toluene, xylene and cumene sulphonates; preservatives; corrosion inhibitors such as silicates, silico aluminates, aluminates, zincates, borates and benzotriazole; structuring agents; abrasives such as silicas and calcite; electrolytes; fluorescers; other bleaches; bleach precursors; colourants such as sulphonated zinc phthalocyanine; coating materials and plasticizers like glycerol; reducing agents; china protecting agents; drainage promoting ingredients; crystal modifiers and the like representing examples of functional additives in dishwashing compositions.

The composition should however contain, before use, subtantially no material which in the aqueous liquor will react with and remove the halite ions. Thus, chlorite ions are known to react with chlorine or chlorine producing materials such as calcium hypochlorite or sodium dichloro-isocyanurate to produce chlorine dioxide. Thus the composition preferably contains, for each part by weight of halite yielding material, less than 0.4 part, advantageously less than 0.1 part by weight of a material which in aqueous media in the absence of UV-light reacts to a substantial extent with the halite ions, i.e. reacts with at least a major proportion of the halite ions.

The invention will now be illustrated by the following non-limiting examples in which percentages and parts are by weight unless otherwise specified.

In the following example heavily tea stained glass filter plates were washed using various compositions and in the presence or absence of UV-light. The % reflectance was measured before and after washing, as an indication of the stain removal effect and hence of the germ killing effect. The glass filters (plates 40 mm diameter, 3 to 4 mm thick, porosity of about 60 microns) were immersed in a solution of tea for 24 hours at ambient temperature, then left to dry for 1 hour at 105° C. The tea solution was prepared by boiling for 5 minutes 20 g/l of tea in tap water (15° GH) and filtering the preparation. The reflectance of the test samples (stained glass filters) were measured (R460*nm) using a Zeiss Elrepho reflectometer fitted with a UV filer. Both front and back of each test sample were measured.

After washing in the various conditions the test samples were rinsed and dried before measuring again the % reflectance (front and back). The reflectance change (before and after washing) ΔR460* given in the following Example is an average of measurements from different washes for each experimental condition.

EXAMPLE 1

A machine dishwashing powder having the following approximate formulation was used:

| | | |
|---|---|---|
| Sodium tripolyphosphate anhydrous | | 33% |
| Sodium disilicate anhydrous (ration 2.4) | | 27% |
| Sodium tetraborate anhydrous | | 7% |
| Water (ex hydrate) | to | 100% |

This formulation is coded "A".

In another composition the water was replaced by sodium chlorite. Composition "B" was therefore approximately the following:

| | |
|---|---|
| Sodium tripolyphosphate anhydrous | 33% |
| Sodium disilicate anhydrous (ratio 2.4) | 27% |
| Sodium tetraborate anhydrous | 7% |
| Sodium chlorite | 33% |

The sodium chlorite used was 80% active (BDH Chemicals Limited, Poole, England).

Treatment liquids were prepared by dispersing the respective formulations in water (15° GH) at a concentration of 3 g/l. In all cases the pH of the solutions was 9.3. In all experiments the samples were immersed in the solutions for 2 hours. Treatment liquids were kept during the experiment at a temperature of 24° C.

The experiments were duplicated in absence or presence of light. The lamp used was an original HANAU quartz lamp-type 002330 covering the spectrum from 200 to 400 nm. The results are given in the following Table I.

TABLE I

| Δ R460* (before/after washing) | | | |
|---|---|---|---|
| no light exposure | | UV-light exposure | |
| Formulation A | Formulation B | Formulation A | Formulation B |
| 28 | 35 | 34 | 49 |

A suitable dishwashing machine for washing dishes with a composition according to the invention may be constructed as follows. A washing chamber is provided with means for supporting the dishes and the like to be washed and means, such as a rotating spray nozzle, for directing wash liquor onto the dishes. A suitable dispenser may be provided into which the user can place the composition according to the invention. Heating means should be included to obtain a desired temperature profile for the washing programme.

The washing chamber may be provided with one or more ultraviolet light sources, for example in a door to the chamber, in one or more of the chamber walls or in the floor or ceiling of the chamber. As an alternative or additional construction, there may be provided an irradiating chamber through which the wash liquor is passed before contact with the dishes, e.g. the wash liquor is continuously recycled through the irradiating chamber. The irradiating chamber would include one or more sources of ultraviolet light.

It is possible for the sources of ultraviolet light to be capable of radiating light in the visible part of the spectrum in order to enable one to utilize dishwashing compositions containing visible light sensitive materials.

Suitable UV-light sources are of the quartz-iodine, xenon or mercury discharge types.

The dishwashing machine should also include suitable control devices to switch on and off the UV-light source or sources and/or to control the output thereof. It may be desirable, for example, to irradiate the dishes and/or the liquor only at certain times during the wash programme. Thus, for example, the delayed switch-on of the UV-light source or sources may be utilized to allow bleach-sensitive materials such as enzymes time to work. Alternatively, the UV-irradiation may only be used in the last rinse of the programme, in which case the composition according to the invention would constitute a rinse product. The control devices should also enable a programme to be selected in which no UV-irradiation takes place. The timing of the UV-irradiation may be controlled by appropriate sensors for parameters such as temperatures, optical density and/or pH.

EXAMPLE 2

A series of machine dishwashing experiments was carried out. Tea-stained cups were washed with formulations according to the invention using a Bauknecht GS 455 de Luxe dishwashing machine provided with an ultraviolet light source under the following conditions:

Machine content: 8 liters tap water of 8° German hardness

Washing time: 30 minutes.

The results are shown in the following Table II.

TABLE II

| UV light source | 125 Watt Quartz Iodine (Thorn lightning) | | | | | | 7W 254nm (Penray) |
|---|---|---|---|---|---|---|---|
| Prod. concentration | mg/l | | mg/l | | mg/l | | mg/l |
| Na—triphosphate | 750 | | 750 | | 750 | | 750 |
| Na—metasilicate | 100 | | 100 | | 100 | | 100 |
| Plurafac ® RA 40(1) | 30 | | 30 | | 30 | | 30 |
| $NaClO_2$ | 50 | | 200 | | 500 | | 500 |
| Temperature (°C.) | 20 → 65 | 20 → 28 | 20 → 65 | 20 → 28 | 20 → 65 | 20 → 27 | 20 → 60 |
| Final pH (measured at final temperat.) | 9.1 | 9.7 | 9.3 | 10.1 | 9.6 | — | 9.1 |
| Score on tea cups Ranking | 2 | 2 | 1 | 1 | 1 | 1 | 1 |

(1) excellent to good
(2) moderate
(3) bad
(4) very bad (1)Plurafac RA 40 is a modified oxyethylated straight chain alcohol liquid nonionic surfactant supplied by the BASF-Wyandotte Comp.

I claim:

1. A machine dishwashing composition for use in a dishwashing machine provided with a source of ultraviolet light having a wavelength of between 200 nm and 400 nm to irradiate the dishes and/or the washing liquor during the wash programme, said composition comprising:
   (i) 10 to 60% by weight of a builder material, which removes calcium ions from solution by sequestration, complexation precipitation or ion-exchange;
   (ii) 5 to 45% by weight of a material yielding halite ions in aqueous media;
   (iii) sufficient alkaline material to give the composition a pH of above 7 when dispersed at 0.5 g/l in water; and
   (iv) 0 to 15% by weight of a low or non-foaming nonionic surfactant.

2. A composition according to claim 1, having a pH of between 8.5 and 11.5.

3. A composition according to claim 1, wherein said material yielding halite ions in aqueous media is sodium chlorite.

4. A composition according to claim 1, containing substantially no surfactant.

5. A composition according to claim 1, containing less than 30% liquid base.

6. A process for washing dishes, comprising the steps of:
   (a) contacting the dishes with an aqueous liquor comprising 0.5 g/l to 10 g/l of a composition according to claim 1, and
   (b) irradiating the aqueous liquor and/or dishes in contact therewith with ultra-violet light having a wave-length of between 200 nm and 400 nm.

* * * * *